US010789907B2

(12) United States Patent
Hwang

(10) Patent No.: US 10,789,907 B2
(45) Date of Patent: Sep. 29, 2020

(54) GAMMA REFERENCE VOLTAGE GENERATING CIRCUIT, DISPLAY APPARATUS INCLUDING THE SAME AND METHOD OF DRIVING DISPLAY PANEL USING THE SAME

(71) Applicant: Samsung Display Co., Ltd., Yongin-si (KR)

(72) Inventor: Jun-Ho Hwang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/215,598

(22) Filed: Dec. 10, 2018

(65) Prior Publication Data

US 2019/0272798 A1 Sep. 5, 2019

(30) Foreign Application Priority Data

Mar. 5, 2018 (KR) ..... 10-2018-0025974

(51) Int. Cl.
*G09G 3/36* (2006.01)
*G09G 3/3208* (2016.01)

(52) U.S. Cl.
CPC ..... *G09G 3/3696* (2013.01); *G09G 3/3208* (2013.01); *G09G 2310/0291* (2013.01); *G09G 2310/0297* (2013.01); *G09G 2320/0276* (2013.01)

(58) Field of Classification Search
CPC ..... G09G 3/3208; G09G 2310/0291; G09G 2310/0297; G09G 2320/0276
See application file for complete search history.

(56) References Cited

U.S. PATENT DOCUMENTS

| | | | | |
|---|---|---|---|---|
| 8,605,122 | B2 | 12/2013 | Weng | |
| 9,613,566 | B2 | 4/2017 | Wang et al. | |
| 10,026,359 | B2 | 7/2018 | Chae et al. | |
| 2004/0021627 | A1* | 2/2004 | Maki | G09G 3/3648 345/89 |

(Continued)

FOREIGN PATENT DOCUMENTS

| | | |
|---|---|---|
| KR | 10-0642112 | 11/2006 |
| KR | 10-2016-0055562 | 5/2016 |
| KR | 10-2017-0042721 | 4/2017 |

*Primary Examiner* — Shaheda A Abdin
(74) *Attorney, Agent, or Firm* — H.C. Park & Associates, PLC

(57) ABSTRACT

A gamma reference voltage generating circuit including a first resistor string disposed between a first reference voltage node and a second reference voltage node, a first multiplexer connected to the first resistor string and determining a level of a first gamma reference voltage, a first amplifier connected to the first multiplexer and outputting the first gamma reference voltage, a first resistor connected between an output terminal of the first amplifier and a first previous gamma voltage output node, a second resistor connected between the output terminal of the first amplifier and a first next gamma voltage output node, a first compensating resistor connected between a second previous gamma voltage output node and the present gamma voltage output node, and a second compensating resistor connected between a second next gamma voltage output node and the present gamma voltage output node.

15 Claims, 7 Drawing Sheets

(56) References Cited

U.S. PATENT DOCUMENTS

| | | | | |
|---|---|---|---|---|
| 2004/0124780 | A1* | 7/2004 | Ha | G09G 3/2011 315/169.3 |
| 2006/0022925 | A1* | 2/2006 | Hara | G09G 3/3688 345/89 |
| 2016/0133192 | A1* | 5/2016 | Chae | G09G 3/3258 345/205 |
| 2016/0189635 | A1* | 6/2016 | Lee | G09G 3/3233 345/690 |

* cited by examiner

GAMMA REFERENCE VOLTAGE GENERATING CIRCUIT, DISPLAY APPARATUS INCLUDING THE SAME AND METHOD OF DRIVING DISPLAY PANEL USING THE SAME

CROSS-REFERENCE TO RELATED APPLICATION

This application claims priority from and the benefit of Korean Patent Application No. 10-2018-0025974, filed on Mar. 5, 2018, which is hereby incorporated by reference for all purposes as if fully set forth herein.

BACKGROUND

Field

Exemplary embodiments of the invention relate generally to a gamma reference voltage generating circuit, a display apparatus including the gamma reference voltage generating circuit and a method of driving a display panel using the display apparatus and, more specifically, to a gamma reference voltage generating circuit generating a gamma reference voltage based on an adjacent gamma voltage, a display apparatus including the gamma reference voltage generating circuit and a method of driving a display panel using the display apparatus.

Discussion of the Background

Generally, a display apparatus includes a display panel and a display panel driver. The display panel includes a plurality of gate lines, a plurality of data lines, and a plurality of pixels. The display panel driver includes a gate driver, a data driver, and a gamma reference voltage generator. The gate driver outputs gate signals to the gate lines. The data driver outputs data voltages to the data lines. The gamma reference voltage generator generates a gamma reference voltage to generate the data voltage.

The gamma reference voltage generator includes a resistor string and a multiplexer. The gamma reference voltage generator generates the gamma reference voltage by voltage dividing of the resistor string. The gamma reference voltages may be generated for predetermined grayscale values and gamma voltages may be generated for remaining grayscale values which are not the predetermined grayscale values by interpolating the gamma reference voltages.

In the conventional method of generating the gamma reference voltage and the interpolation method, gamma smoothness may be reduced in specific grayscale values.

The above information disclosed in this Background section is only for understanding of the background of the inventive concepts, and, therefore, it may contain information that does not constitute prior art.

SUMMARY

Exemplary embodiments of the inventive concepts provide a gamma reference voltage generating circuit generating a gamma reference voltage based on an adjacent gamma voltage.

Exemplary embodiments of the inventive concepts also provide a display apparatus including the gamma reference voltage generating circuit.

Exemplary embodiments of the inventive concepts also provide a method of driving a display panel using the display apparatus.

Additional features of the inventive concepts will be set forth in the description which follows, and in part will be apparent from the description, or may be learned by practice of the inventive concepts.

An exemplary embodiment of the present inventive concepts provides a gamma reference voltage generating circuit including a first resistor string, a first multiplexer, a first amplifier, a first resistor, a second resistor, a first compensating resistor, and a second compensating resistor. The first resistor string is disposed between a first reference voltage node and a second reference voltage node. The first multiplexer is connected to the first resistor string and is configured to determine a level of a first gamma reference voltage. The first amplifier is connected to the first multiplexer and is configured to output the first gamma reference voltage. The first resistor is connected between an output terminal of the first amplifier and a first previous gamma voltage output node of a present gamma voltage output node. The second resistor is connected between the output terminal of the first amplifier and a first next gamma voltage output node of the present gamma voltage output node. The first compensating resistor is connected between a second previous gamma voltage output node of the present gamma voltage output node and the present gamma voltage output node. The second compensating resistor is connected between a second next gamma voltage output node of the present gamma voltage output node and the present gamma voltage output node.

The first previous gamma voltage output node may be same as the second previous gamma voltage output node. The first previous gamma voltage output node and the second previous gamma voltage output node may be a right previous output node of the present gamma voltage output node. The first next gamma voltage output node may be same as the second next gamma voltage output node. The first next gamma voltage output node and the second next gamma voltage output node may be a right next output node of the present gamma voltage output node.

The first previous gamma voltage output node may be different from the second previous gamma voltage output node. The first next gamma voltage output node may be different from the second next gamma voltage output node.

The first previous gamma voltage output node may be a right previous output node of the present gamma voltage output node. The first next gamma voltage output node may be a right next output node of the present gamma voltage output node.

The second previous gamma voltage output node may be one of previous output nodes of the first previous gamma voltage output node. The second next gamma voltage output node may be one of next output nodes of the first next gamma voltage output node.

The gamma reference voltage generating circuit may further include a first switch disposed between the output terminal of the first amplifier and the present gamma voltage output node.

The gamma reference voltage generating circuit may further include a second switch disposed between the second previous gamma voltage output node and the present gamma voltage output node and connected to the first compensating resistor in series and a third switch disposed between the second next gamma voltage output node and the present gamma voltage output node and connected to the second compensating resistor in series.

The first switch may be turned off and the second switch and the third switch may be turned on in a first operation mode. The first switch may be turned on and the second switch and the third switch may be turned off in a second operation mode.

The gamma reference voltage generating circuit may further include a second resistor string disposed between a third reference voltage node and a fourth reference voltage node, a second multiplexer connected to the second resistor string and configured to determine a level of a second gamma reference voltage corresponding to a grayscale value lower than the first gamma reference voltage, a second amplifier connected to the second multiplexer and configured to output the second gamma reference voltage and a first group of resistors disposed between the output terminal of the first amplifier and an output terminal of the second amplifier. The fourth reference voltage may be a voltage of the output terminal of the first amplifier.

The gamma reference voltage generating circuit may further include a third resistor string disposed between a fifth reference voltage node and a sixth reference voltage node, a third multiplexer connected to the third resistor string and configured to determine a level of a third gamma reference voltage corresponding to a grayscale value greater than the first gamma reference voltage, a third amplifier connected to the third multiplexer and configured to output the third gamma reference voltage and a second group of resistors disposed between the output terminal of the first amplifier and an output terminal of the third amplifier. The second reference voltage may be a voltage of the output terminal of the third amplifier.

Another exemplary embodiment of the inventive concepts provides a display apparatus including a gamma reference voltage generator, a data driver and a display panel. The gamma reference voltage generator includes a first resistor string, a first multiplexer, a first amplifier, a first resistor, a second resistor, a first compensating resistor and a second compensating resistor. The first resistor string is disposed between a first reference voltage node and a second reference voltage node. The first multiplexer is connected to the first resistor string and configured to determine a level of a first gamma reference voltage. The first amplifier is connected to the first multiplexer and configured to output the first gamma reference voltage. The first resistor is connected between an output terminal of the first amplifier and a first previous gamma voltage output node of a present gamma voltage output node. The second resistor is connected between the output terminal of the first amplifier and a first next gamma voltage output node of the present gamma voltage output node. The first compensating resistor is connected between a second previous gamma voltage output node of the present gamma voltage output node and the present gamma voltage output node. The second compensating resistor is connected between a second next gamma voltage output node of the present gamma voltage output node and the present gamma voltage output node. The gamma reference voltage generator generates a plurality of gamma reference voltages including the first gamma reference voltage. The data driver outputs a data voltage based on the plurality of the gamma reference voltages. The display panel displays an image based on the data voltage.

The display apparatus may further include a gate driver which outputs a gate signal to the display panel and a timing controller which controls driving timings of the gate driver and the data driver. The timing controller, the data driver and the gamma reference voltage generator are formed as a single chip.

Another exemplary embodiment of the inventive concepts provides a method of driving a display panel, including generating a first gamma reference voltage corresponding to a first grayscale value, a second gamma reference voltage corresponding to a second grayscale value greater than the first grayscale value, and a third gamma reference voltage corresponding to a third grayscale value greater than the second grayscale value, generating a previous gamma voltage of the second gamma reference voltage using the first gamma reference voltage and the second gamma reference voltage, and a next gamma voltage of the second gamma reference voltage using the second gamma reference voltage and the third gamma reference voltage, generating a second gamma compensated reference voltage corresponding to the second grayscale value based on the previous gamma voltage of the second gamma reference voltage and the next gamma voltage of the second gamma reference voltage, outputting a gate signal to the display panel and outputting a data voltage based on a plurality of gamma reference voltages including the first gamma reference voltage, the second gamma compensated reference voltage, and the third gamma reference voltage.

The second gamma compensated reference voltage may be generated using a first resistor disposed between a present gamma voltage output node configured to output the second gamma compensated reference voltage and a previous gamma voltage output node configured to output the previous gamma voltage of the second gamma reference voltage and a second resistor disposed between the present gamma voltage output node and a next gamma voltage output node configured to output the next gamma voltage of the second gamma reference voltage.

The previous gamma voltage output node may be a right previous output node of the present gamma voltage output node. The next gamma voltage output node may be a right next output node of the present gamma voltage output node.

The previous gamma voltage output node may be a second previous output node from the present gamma voltage output node. The next gamma voltage output node may be a second next output node from the present gamma voltage output node.

A first switch may be disposed between a node generating the second gamma reference voltage and a node outputting the second gamma compensated reference voltage.

A second switch may be disposed between the previous gamma voltage output node and the present gamma voltage output node. A third switch may be disposed between the next gamma voltage output node and the present gamma voltage output node.

The first switch may be turned off and the second switch and the third switch may be turned on in a first operation mode. The first switch may be turned on and the second switch and the third switch may be turned off in a second operation mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
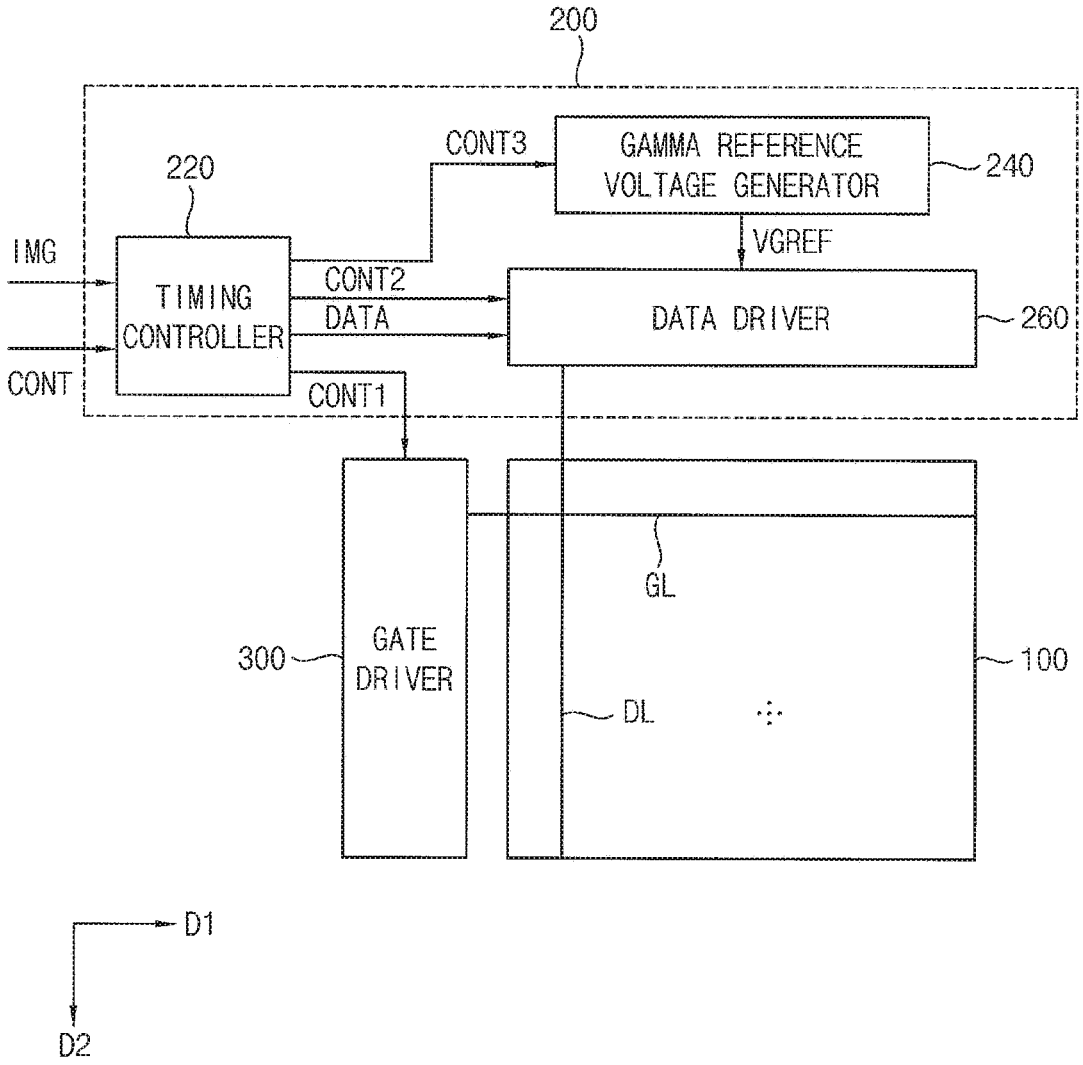
FIG. 1 is a block diagram illustrating a display apparatus according to an exemplary embodiment of the inventive concepts.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display apparatus according to an exemplary embodiment of the inventive concepts.

Referring to FIG. 1, the display apparatus includes a display panel 100, a gate driver 300, and a timing controller embedded data driver 200. The timing controller embedded data driver 200 includes a timing controller 220, a gamma reference voltage generator 240, and a data driver 260. For example, the timing controller embedded data driver 200 may be formed as a single chip.

The display panel 100 includes a plurality of gate lines GL, a plurality of data lines DL, and a plurality of pixels electrically connected to the gate lines GL and the data lines DL. The gate lines GL extend in a first direction D1 and the data lines DL extend in a second direction D2 crossing the first direction D1.

The display panel 100 may be an organic light emitting display panel including a plurality of organic light emitting diodes. Alternatively, the display panel 100 may be a liquid crystal display panel including a liquid crystal layer.

The timing controller 220 receives input image data IMG and an input control signal CONT from an external apparatus (not shown). The input image data IMG may include red image data, green image data, and blue image data. The input image data IMG may include white image data. The input image data IMG may include at least one of magenta image data, yellow image data, and cyan image data. The input control signal CONT may include a master clock signal and a data enable signal. The input control signal CONT may further include a vertical synchronizing signal and a horizontal synchronizing signal.

The timing controller 220 generates a first control signal CONT1, a second control signal CONT2, a third control signal CONT3, and a data signal DATA based on the input image data IMG and the input control signal CONT.

The timing controller 220 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 220 generates the second control signal CONT2 for controlling an operation of the data driver 260 based on the input control signal CONT, and outputs the second control signal CONT2 to the data driver 260. The second control signal CONT2 may include a horizontal start signal and a load signal.

The timing controller 220 generates the data signal DATA based on the input image data IMG. The timing controller 220 outputs the data signal DATA to the data driver 260.

The timing controller 220 generates the third control signal CONT3 for controlling an operation of the gamma reference voltage generator 240 based on the input control signal CONT, and outputs the third control signal CONT3 to the gamma reference voltage generator 240. Alternatively, the gamma reference voltage generator 240 may not receive the control signal from the timing controller 220 so that the gamma reference voltage generator 240 may be operated independently from the timing controller 220.

The gate driver 300 generates gate signals driving the gate lines GL in response to the first control signal CONT1 received from the timing controller 220. The gate driver 300 may sequentially output the gate signals to the gate lines GL.

The gamma reference voltage generator 240 generates a gamma reference voltage VGREF in response to the third control signal CONT3 received from the timing controller 220. The gamma reference voltage generator 240 provides the gamma reference voltage VGREF to the data driver 260. The gamma reference voltage VGREF has a value corresponding to a level of the data signal DATA.

The structure and the operation of the gamma reference voltage generator 240 are explained referring to FIGS. 2 to 6 in detail.

The data driver 260 receives the second control signal CONT2 and the data signal DATA from the timing controller 220, and receives the gamma reference voltages VGREF from the gamma reference voltage generator 240. The data driver 260 converts the data signal DATA into data voltages having an analog type using the gamma reference voltages VGREF. The data driver 260 outputs the data voltages to the data lines DL.

Figure 2:
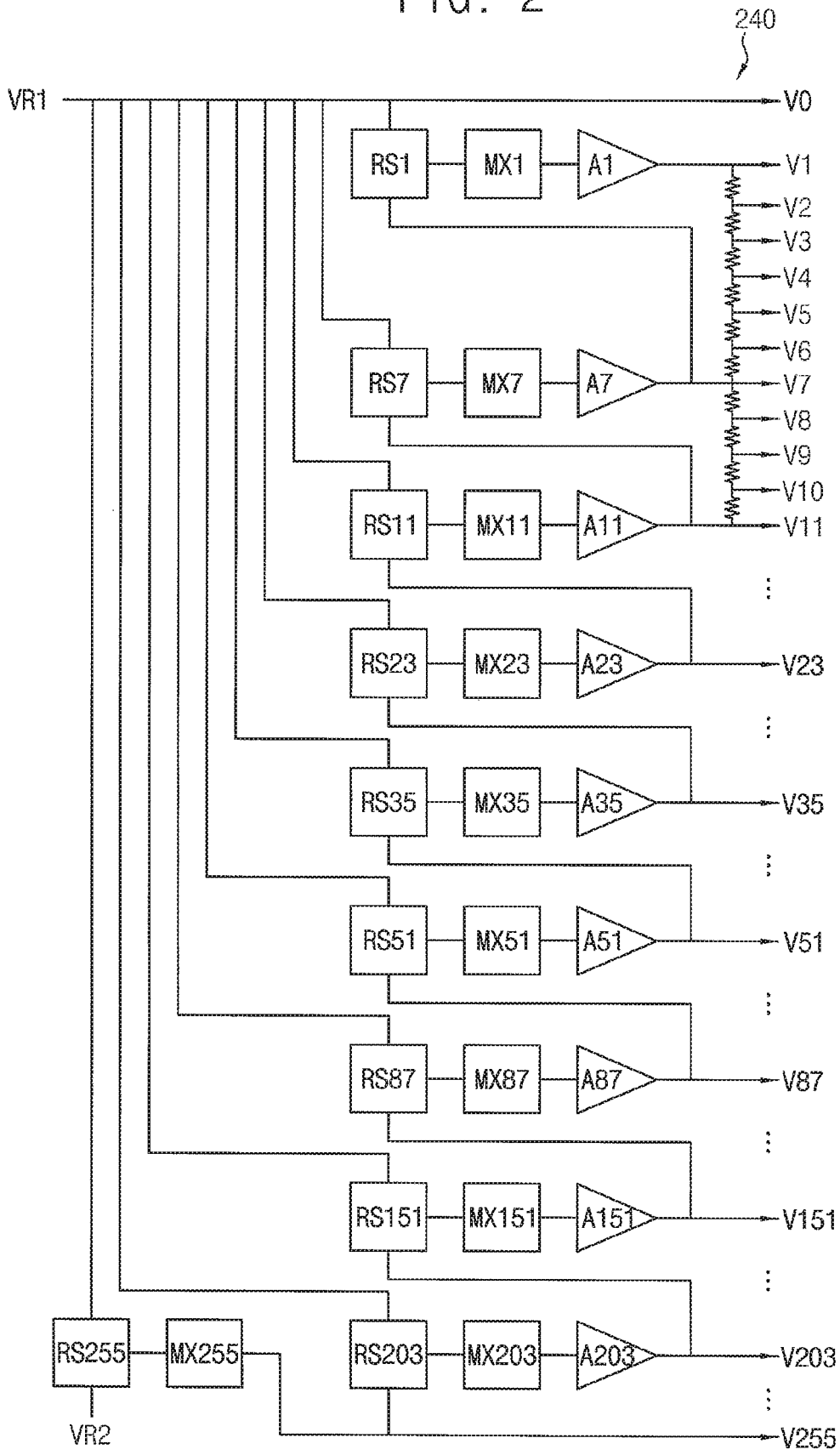
FIG. 2 is a circuit diagram illustrating an exemplary gamma reference voltage generating part of FIG. 1.

FIG. 2 is a circuit diagram illustrating an exemplary gamma reference voltage generating part 240 of FIG. 1.

Referring to FIGS. 1 and 2, the gamma reference voltage generating part 240 may generate a plurality of gamma reference voltages corresponding to predetermined grayscale values based on reference voltages. The gamma reference voltage generating part 240 may generate a plurality of gamma voltages corresponding to remaining grayscale values, except for the predetermined grayscale values, by interpolating the gamma reference voltages.

In FIG. 2, the gamma reference voltage generating part 240 may generate the gamma reference voltages and the gamma voltages for 255 grayscale values. In FIG. 2, VR1 and VR2 are examples of the reference voltages, V0, V1, V7, V11, V23, V35, V51, V87, V151, V203, and V255 are examples of the gamma reference voltages corresponding to 0 grayscale, 1 grayscale, 7 grayscale, 11 grayscale, 23 grayscale, 35 grayscale, 51 grayscale, 87 grayscale, 151 grayscale, 203 grayscale, and 255 grayscale, respectively, and the remaining voltages (V2 to V6, V8 to V10, and so on) corresponding to remaining grayscale values are examples of the gamma voltages generated by interpolating the gamma reference voltages.

Although the reference voltages only include VR1 and VR2 in the exemplary embodiment of FIG. 2 for convenience of explanation, the inventive concepts are not limited thereto. The number of the reference voltages for generating the gamma reference voltages (e.g. V0, V1, V7, V11, V23, V35, V51, V87, V151, V203, and V255) and the gamma voltages (e.g. V2 to V6, V8 to V10, and so on) may be greater than two.

For example, the gamma reference voltage V0 corresponding to 0 grayscale may be a first reference voltage VR1.

The gamma reference voltage V1 corresponding to 1 grayscale may be generated using a resistor string RS1, a multiplexer MX1 connected to the resistor string RS1 and determining a level of the gamma reference voltage V1, and an amplifier A1 connected to the multiplexer MX1 and outputting the gamma reference voltage V1. The resistor string RS1 may include a plurality of resistors disposed between the first reference voltage VR1 and a gamma reference voltage V7 corresponding to 7 grayscale. Thus, the level of the gamma reference voltage V1 corresponding to 1 grayscale may be determined between the first reference voltage VR1 and a level of the gamma reference voltage V7 corresponding to 7 grayscale. The multiplexer MX1 may determine a position of the resistor string RS1 to be connected to the amplifier A1. According to the position of the resistor string RS1 to be connected to the amplifier A1 by the multiplexer MX1, the level of the gamma reference voltage V1 corresponds to 1 grayscale.

The gamma reference voltage V7 corresponding to 7 grayscale may be generated using a resistor string RS7, a multiplexer MX7 connected to the resistor string RS7 and determining a level of the gamma reference voltage V7, and an amplifier A7 connected to the multiplexer MX7 and outputting the gamma reference voltage V7. The resistor string RS7 may include a plurality of resistors disposed between the gamma reference voltage V7 corresponding to 7 grayscale the first reference voltage VR1 and a gamma reference voltage V11 corresponding to 11 grayscale. Thus, the level of the gamma reference voltage V7 corresponding to 7 grayscale may be determined between the first reference voltage VR1 and a level of the gamma reference voltage V11 corresponding to 11 grayscale. The multiplexer MX7 may determine a position of the resistor string RS7 to be connected to the amplifier A7. According to the position of the resistor string RS7 to be connected to the amplifier A7 by the multiplexer MX7, the level of the gamma reference voltage V7 corresponds to 7 grayscale.

Gamma voltages V2 to V6 corresponding to 2 grayscale to 6 grayscale, respectively, may be generated using the gamma reference voltage V1 corresponding to 1 grayscale and the gamma reference voltage V7 corresponding to 7 grayscale.

A plurality of resistors connected to each other in series may be disposed between the amplifier A1 outputting the gamma reference voltage V1 and the amplifier A7 outputting the gamma reference voltage V7. The gamma voltages V2 to V6 corresponding to 2 grayscale to 6 grayscale, respectively, may be generated by the resistors connected to each other in series. For example, the resistors disposed between the amplifier A1 outputting the gamma reference voltage V1 and the amplifier A7 outputting the gamma reference voltage V7 may have the same resistances. When the resistors disposed between the amplifier A1 outputting the gamma reference voltage V1 and the amplifier A7 outputting the gamma reference voltage V7 have the same resistances, the gamma voltages V2 to V6 corresponding to 2 grayscale to 6 grayscale, respectively, may be generated by linear interpolation.

The gamma reference voltage V11 corresponding to 11 grayscale may be generated using a resistor string RS11, a multiplexer MX11 connected to the resistor string RS11 and determining a level of the gamma reference voltage V11, and an amplifier A11 connected to the multiplexer MX11 and outputting the gamma reference voltage V11.

Gamma voltages V8 to V10 corresponding to 8 grayscale to 10 grayscale, respectively, may be generated using the gamma reference voltage V7 corresponding to 7 grayscale and the gamma reference voltage V11 corresponding to 11 grayscale.

A plurality of resistors connected to each other in series may be disposed between the amplifier A7 outputting the gamma reference voltage V7 and the amplifier A11 outputting the gamma reference voltage V11. The gamma voltages V8 to V10 corresponding to 8 grayscale to 10 grayscale may be generated by the resistors connected to each other in series. For example, the resistors disposed between the amplifier A7 outputting the gamma reference voltage V7 and the amplifier A11 outputting the gamma reference voltage V11 may have the same resistances. When the resistors disposed between the amplifier A7 outputting the gamma reference voltage V7 and the amplifier A11 outputting the gamma reference voltage V11 have the same resistances, the gamma voltages V8 to V10 corresponding to 8 grayscale to 10 grayscale may be generated by linear interpolation.

The gamma reference voltage V23 corresponding to 23 grayscale may be generated using a resistor string RS23, a multiplexer MX23 connected to the resistor string RS23, and determining a level of the gamma reference voltage V23 and an amplifier A23 connected to the multiplexer MX23 and outputting the gamma reference voltage V23.

Gamma voltages V12 to V22 corresponding to 12 grayscale to 22 grayscale may be generated using the gamma reference voltage V11 corresponding to 11 grayscale and the gamma reference voltage V23 corresponding to 23 grayscale.

A plurality of resistors connected to each other in series may be disposed between the amplifier A11 outputting the gamma reference voltage V11 and the amplifier A23 outputting the gamma reference voltage V23. The gamma voltages V12 to V22 corresponding to 12 grayscale to 22 grayscale may be generated by the resistors connected to each other in series.

Gamma reference voltages V35, V51, V87, V151, and V203 corresponding to 35 grayscale, 51 grayscale, 87 grayscale, 151 grayscale, and 203 grayscale may be generated using resistor strings RS35, RS51, RS87, RS151, and RS203, respectively, multiplexers MX35, MX51, MX87, MX151, and MX203 respectively connected to the resistor strings RS35, RS51, RS87, RS151, and RS203 and respectively determining levels of the gamma reference voltages V35, V51, V87, V151, and V203, and amplifiers A35, A51, A87, A151, and A203 connected to the multiplexers MX35, MX51, MX87, MX151, and MX203, respectively, and outputting the gamma reference voltages V35, V51, V87, V151, and V203, respectively.

The gamma reference voltage V255 corresponding to 255 grayscale may be generated using a resistor string RS255 disposed between the first reference voltage VR1 and a second reference voltage VR2, and a multiplexer MX255 connected to the resistor string RS255.

Although the gamma reference voltages V0, V1, V7, V11, V23, V35, V51, V87, V151, V203 and V255 are generated based on the first reference voltage VR1 in the present exemplary embodiment, the reference voltage to generate the gamma reference voltages V0, V1, V7, V11, V23, V35, V51, V87, V151, V203 and V255 is not limited to the first reference voltage VR1 in the inventive concepts.

In addition, although the gamma reference voltage is generated for the predetermined grayscale values of 0 grayscale, 1 grayscale, 7 grayscale, 11 grayscale, 23 grayscale, 35 grayscale, 51 grayscale, 87 grayscale, 151 grayscale, 203 grayscale and 255 grayscale in a disclosed exemplary embodiment, the inventive concepts are not limited to the above predetermined grayscale values.

In addition, although the number of the gamma reference voltages is eleven in the disclosed exemplary embodiment, the inventive concepts are not limited to the number of the gamma reference voltages.

Figure 3:
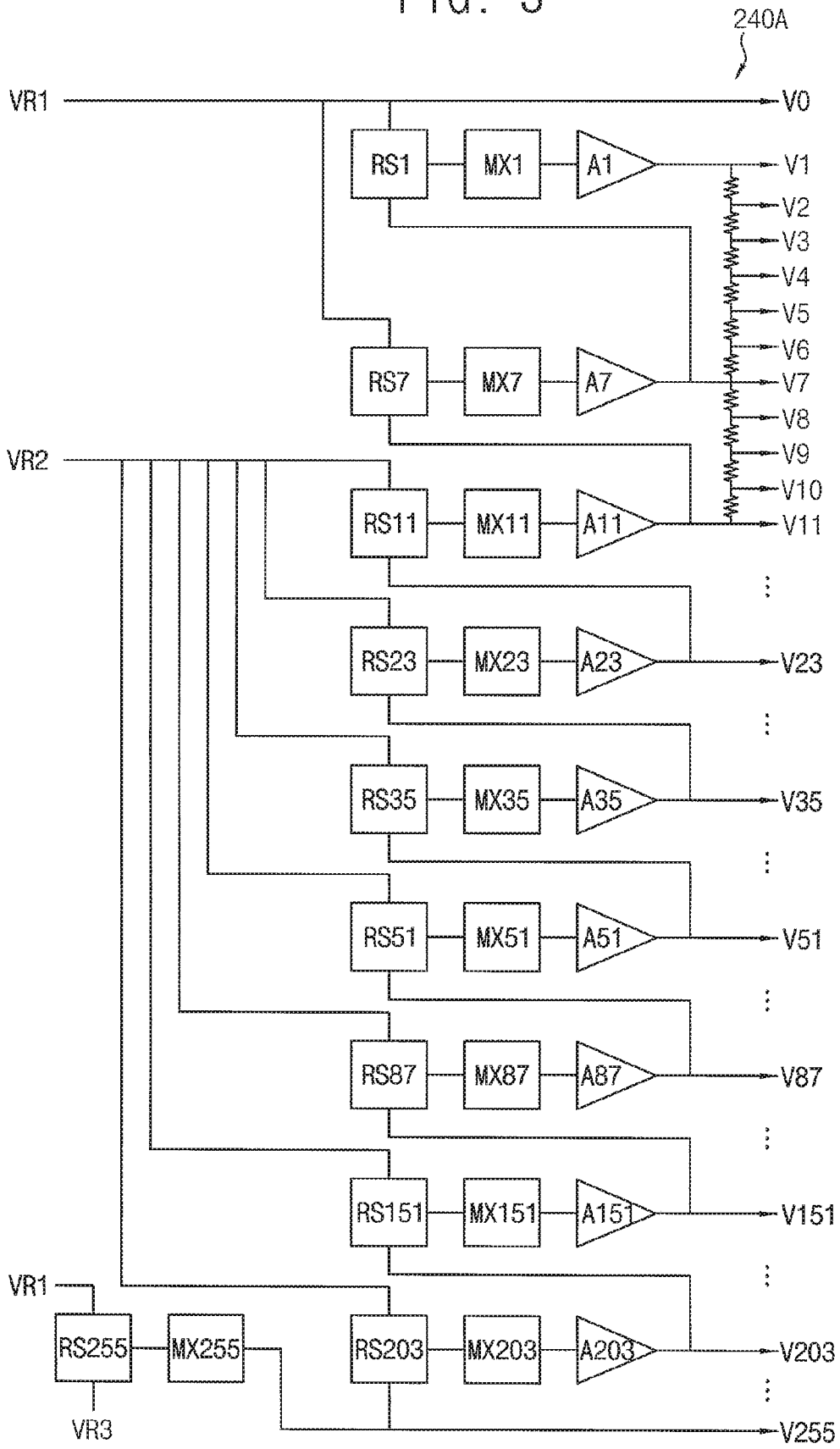
FIG. 3 is a circuit diagram illustrating an exemplary gamma reference voltage generating part of FIG. 1.

FIG. 3 is a circuit diagram illustrating an exemplary gamma reference voltage generating part of FIG. 1.

The gamma reference voltage generator according to this exemplary embodiment is substantially the same as the gamma reference voltage generator of the previous exemplary embodiment explained referring to FIG. 2 except for the reference voltage for generating the gamma reference voltage and the gamma voltage. Thus, the same reference numerals will be used to refer to the same or like parts as those described in the previous exemplary embodiment of FIG. 2 and any repetitive explanation concerning the above elements will be omitted.

Referring to FIGS. 1 to 3, the gamma reference voltage generating part 240A may generate a plurality of gamma reference voltages corresponding to predetermined grayscale values based on reference voltages. The gamma reference voltage generating part 240A may generate a plurality of gamma voltages corresponding to remaining grayscale values except for the predetermined grayscale values by interpolating the gamma reference voltages.

For example, the gamma reference voltage V0 corresponding to 0 grayscale may be a first reference voltage VR1.

A resistor string RS1 for generating a gamma reference voltage V1 corresponding to 1 grayscale is disposed between the first reference voltage VR1 and a gamma reference voltage V7 corresponding to 7 grayscale. Thus, the level of the gamma reference voltage V1 corresponding to 1 grayscale may be determined between the first reference voltage VR1 and a level of the gamma reference voltage V7 corresponding to 7 grayscale.

A resistor string RS7 for generating a gamma reference voltage V7 corresponding to 7 grayscale is disposed between the first reference voltage VR1 and a gamma reference voltage V11 corresponding to 11 grayscale. Thus, the level of the gamma reference voltage V7 corresponding to 7 grayscale may be determined between the first reference voltage VR1 and a level of the gamma reference voltage V11 corresponding to 11 grayscale.

In the present exemplary embodiment, a resistor string RS11 for generating a gamma reference voltage V11 corresponding to 11 grayscale is disposed between a second reference voltage VR2 instead of the first reference voltage VR1 and a gamma reference voltage V23 corresponding to 23 grayscale. Thus, the level of the gamma reference voltage V11 corresponding to 11 grayscale may be determined between the second reference voltage VR2 and a level of the gamma reference voltage V23 corresponding to 23 grayscale.

Resistor strings RS23, RS35, RS51, RS87, RS151, and RS203 for generating gamma reference voltages V23, V35, V51, V87, V151, and V203 respectively corresponding to 23, 35, 51, 87, 151 and 203 grayscales are connected to the second reference voltage VR2. Thus, the levels of the gamma reference voltages V23, V35, V51, V87, V151, and V203 corresponding to 23, 35, 51, 87, 151, and 203 grayscales, respectively, may be determined between the second reference voltage VR2 and the levels of the subsequent gamma reference voltages.

The gamma reference voltage V255 corresponding to 255 grayscale may be generated using a resistor string RS255 disposed between the first reference voltage VR1 and a third reference voltage VR3 different from the first and second reference voltages VR1 and VR2, and a multiplexer MX255 connected to the resistor string RS255.

Figure 4:
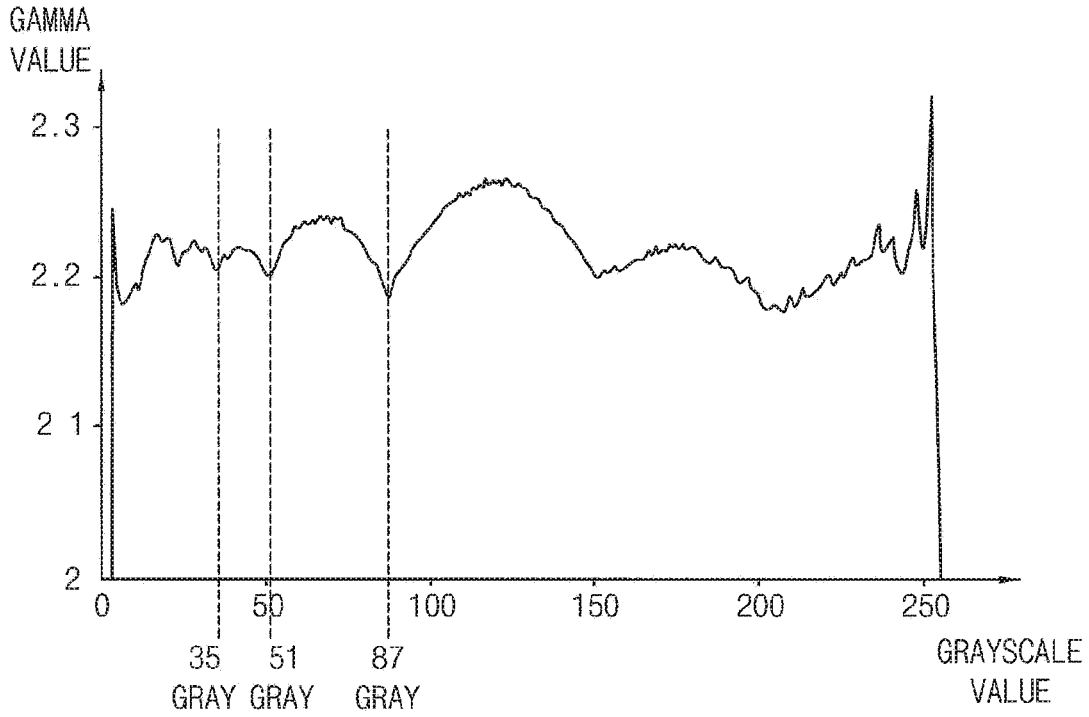
FIG. 4 is a graph illustrating a gamma voltage according to a grayscale value.
Figure 5:
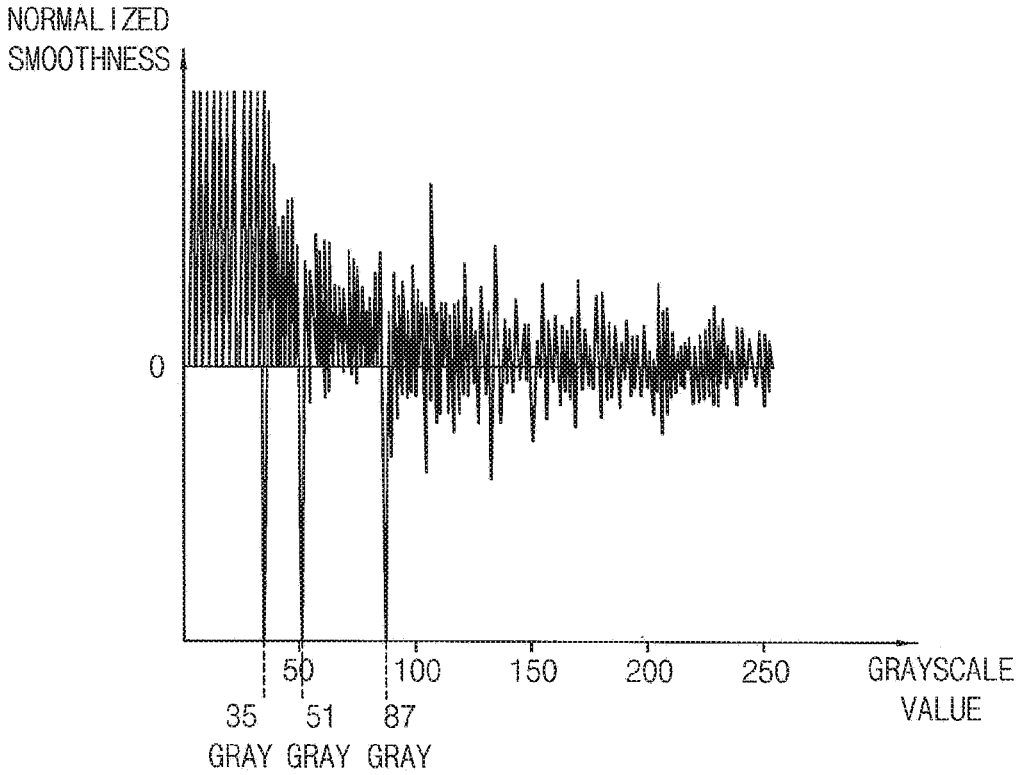
FIG. 5 is a graph illustrating gamma smoothness according to the grayscale value.

FIG. 4 is a graph illustrating a gamma voltage according to a grayscale value. FIG. 5 is a graph illustrating gamma smoothness according to the grayscale value.

Referring to FIG. 4, the gamma values are generated by the gamma reference voltage generator 240 and 240A of FIGS. 2 and 3 according to the grayscale values. The gamma values are used to nonlinearly convert the linear input image using a nonlinear transfer function. Generally, the gamma value may be set to 2.2. When the gamma value is 2.2, the display quality may be acceptable. In the present exemplary embodiment, the gamma value is set to 2.2.

The grayscale value, luminance, and the gamma value may satisfy following Equation 1 and Equation 2, where "gray" means a specific grayscale value; "Lgray" means luminance at the specific grayscale value "gray"; "L255" means luminance at 255 grayscale; and y means the gamma value.

$$Lgray = L255\left(\frac{\text{gray}}{255}\right), \quad \text{[Equation 1]}$$

$$\gamma = \frac{\log\left(\frac{Lgray}{L255}\right)}{\log\left(\frac{\text{gray}}{255}\right)} \quad \text{[Equation 2]}$$

The gamma reference voltage generator 240 and 240A of FIGS. 2 and 3 sets the gamma value y to 2.2 or similar at a predetermined grayscale point (e.g., 0 grayscale, 1 grayscale, 7 grayscale, 11 grayscale, 23 grayscale, 35 grayscale, 51 grayscale, 87 grayscale, 151 grayscale, 203 grayscale, and 255 grayscale). The gamma reference voltage generator 240 and 240A of FIGS. 2 and 3 generates the gamma voltages for the remaining grayscale values except for the predetermined grayscale points by interpolation explained referring to FIGS. 2 and 3.

The gamma values for the remaining grayscale values except for the predetermined grayscale points are generated by linear interpolation, and the gamma values have a log scale so that a curve of the gamma values for the remaining grayscale values except for the predetermined grayscale points may have a convex shape as shown in FIG. 4.

The gamma smoothness means a change amount of the gamma value so that the gamma smoothness may be obtained by comparing the gamma value to the adjacent gamma value. A normalized gamma smoothness may be represented by Equation 3, where "i" means a specific grayscale value; "i−1" means a right previous grayscale value of the specific grayscale value "i"; and "i+1" means a right next grayscale value of the specific grayscale value "i." L(i), L(i−1), and L(i+1) mean luminances at the grayscale values i, i−1, and i+1, respectively.

$$\text{normalized}\,\gamma\,\text{smoothness} = \frac{L(i+1) - 2L(i) + L(i-1)}{L255} \quad \text{[Equation 3]}$$

As shown in FIG. 4, vertexes are formed at the predetermined grayscale points (35 grayscale, 51 grayscale and 87 grayscale) having the gamma reference voltages. Previous and next points of the predetermined grayscale points (35 grayscale, 51 grayscale and 87 grayscale) have inclinations having polarities opposite to each other. In addition, as shown in FIG. 5, the normalized gamma smoothness dramatically decreases at the predetermined grayscale points (35 grayscale, 51 grayscale and 87 grayscale) having the gamma reference voltages. When the normalized gamma smoothness is zero, the gamma values have a uniform level according to the grayscale values. Thus, a normalized gamma smoothness of zero is desirable.

As shown in FIG. 5, when the normalized gamma smoothness is far from zero, the image may be distorted as the grayscales of the image are gradually changed. The distortion of the image may be shown to a user so that the display quality of the display panel 100 may be deteriorated.

Figure 6:
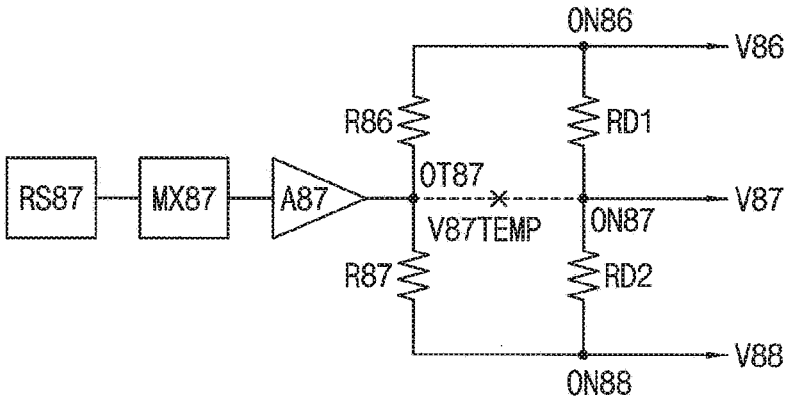
FIG. 6 is a circuit diagram illustrating a portion of the gamma reference voltage generator of FIG. 1 generating a gamma reference voltage corresponding to 87 grayscale.

FIG. 6 is a circuit diagram illustrating a portion of the gamma reference voltage generator of FIG. 1 generating a gamma reference voltage corresponding to 87 grayscale.

Referring to FIGS. 1 to 6, the gamma reference voltage generator 240 according to the present exemplary embodiment may generate the gamma reference voltage (e.g., V87) at the predetermined grayscale point (e.g., 87 grayscale) using adjacent gamma voltages (e.g., V86 and V88) and not by outputting the output of the amplifier (e.g. A87). An output terminal (e.g., OT87) of the amplifier (e.g. A87) may be disconnected from an output part (e.g. ON87) outputting the gamma reference voltage.

As shown in FIG. 6, a gamma reference voltage generating part corresponding to 87 grayscale may include a first resistor string RS87 disposed between a first reference voltage (e.g. VR1 of FIG. 2 or VR2 of FIG. 3) and a second reference voltage (V151 of FIG. 2 or 3), a first multiplexer MX87 connected to the first resistor string RS87 and determining a level of a first gamma reference voltage V87TEMP, and a first amplifier A87 connected to the first multiplexer MX87 and outputting the first gamma reference voltage V87TEMP.

A first resistor R86 may be disposed between the output terminal OT87 of the first amplifier A87 and a first previous gamma voltage output node ON86 of a present gamma voltage output node ON87. The first resistor R86 may be one of resistors disposed between the first amplifier A87 and a previous amplifier A51.

A second resistor R87 may be disposed between the output terminal OT87 of the first amplifier A87 and a first next gamma voltage output node ON88 of the present gamma voltage output node ON87. The second resistor R87 may be one of resistors disposed between the first amplifier A87 and a next amplifier A151.

A first compensating resistor RD1 may be disposed between a second previous gamma voltage output node (ON86 in the present exemplary embodiment) of the present gamma voltage output node ON87 and the present gamma voltage output node ON87.

A second compensating resistor RD2 may be disposed between a second next gamma voltage output node (ON88 in the present exemplary embodiment) of the present gamma voltage output node ON87 and the present gamma voltage output node ON87.

In the present exemplary embodiment, the first previous gamma voltage output node ON86 and the second previous gamma voltage output node ON86 may be same and the first previous gamma voltage output node ON86 and the second previous gamma voltage output node ON86 may be a right previous output node ON86 of the present gamma voltage output node ON87. The right previous output node ON86 may be the closest node to the present gamma voltage output node ON87 among the previous output nodes of the present gamma voltage output node ON87.

In addition, the first next gamma voltage output node ON88 and the second next gamma voltage output node ON88 may be same and the first next gamma voltage output node ON88 and the second next gamma voltage output node ON88 may be a right next output node ON88 of the present gamma voltage output node ON87. The right next output node ON88 may be the closest node to the present gamma voltage output node ON87 among the next output nodes of the present gamma voltage output node ON87.

For example, resistance of the first compensating resistor RD1 may be the same as resistance of the second compensating resistor RD2. The gamma compensated reference voltage V87 may be determined as an average value of the voltage of the right previous output node ON86 and the voltage of the right next output node ON88.

For example, the voltage of the output terminal OT87 of the first amplifier A87 may be referred as the first gamma reference voltage V87TEMP and the output voltage of the present gamma voltage output node ON87 may be referred as the first gamma compensated reference voltage V87. The first gamma compensated reference voltage V87 may be outputted to the data driver 260.

In the present exemplary embodiment, the average value of the gamma voltage of 86 grayscale and the gamma voltage of 88 grayscale is outputted as the gamma compensated reference voltage of 87 grayscale instead of the output voltage of the amplifier A87. However, the inventive concepts are not limited thereto. The gamma compensated reference voltages may be generated based on the adjacent gamma voltages at the predetermined grayscale points (e.g. 1 grayscale, 7 grayscale, 11 grayscale, 23 grayscale, 35 grayscale, 51 grayscale, 87 grayscale, 151 grayscale, and 203 grayscale).

The gamma reference voltage generator 240 may further include a second resistor string RS51 disposed between a third reference voltage (e.g. VR1 of FIG. 2 or VR2 of FIG. 3) and a fourth reference voltage (V87TEMP of FIG. 6), a second multiplexer MX51 connected to the second resistor string RS51 and determining a level of a second gamma reference voltage corresponding to a grayscale value lower than the first gamma reference voltage V87TEMP, a second amplifier A51 connected to the second multiplexer MX51 and outputting the second gamma reference voltage and a first group of resistors disposed between the output terminal OT87 of the first amplifier A87 and an output terminal of the second amplifier A51. The fourth reference voltage may be the voltage V87TEMP of the output terminal OT87 of the first amplifier A87.

The gamma reference voltage generator 240 may further include a third resistor string RS151 disposed between a fifth reference voltage (e.g. VR1 of FIG. 2 or VR2 of FIG. 3) and a sixth reference voltage (V203 of FIG. 2 or 3), a third multiplexer MX151 connected to the third resistor string RS151 and determining a level of a third gamma reference voltage corresponding to a grayscale value greater than the first gamma reference voltage V87TEMP, a third amplifier A151 connected to the third multiplexer MX151 and outputting the third gamma reference voltage and a second group of resistors disposed between the output terminal OT87 of the first amplifier A87 and an output terminal of the third amplifier A151. The second reference voltage may be the voltage V151 of the output terminal of the third amplifier A151.

According to the present exemplary embodiment, the gamma reference voltage V87 compensated using the voltage of the right previous output node ON86 of the present gamma voltage output node ON87 and the voltage of the right next output node ON88 of the present gamma voltage output node ON87 are outputted to the data driver 260 instead of the gamma reference voltage V87TEMP outputted from the first amplifier A87.

Thus, the vertex at 87 grayscale in FIG. 4 may be removed and the gamma smoothness at 87 grayscale may be changed to a value close to zero. Therefore, the distortion of the image may be prevented so that the display quality of the display panel 100 may be enhanced.

Figure 7:
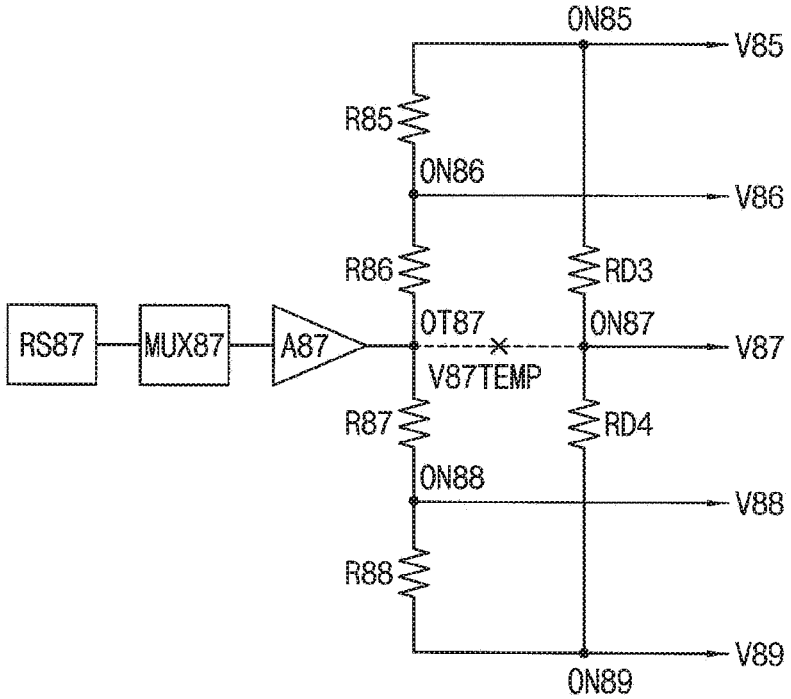
FIG. 7 is a circuit diagram illustrating a portion of a gamma reference voltage generator according to an exemplary embodiment of the inventive concepts generating a gamma reference voltage corresponding to 87 grayscale.

FIG. 7 is a circuit diagram illustrating a portion of a gamma reference voltage generator according to an exemplary embodiment of the present inventive concept generating a gamma reference voltage corresponding to 87 grayscale.

The display apparatus according to the present exemplary embodiment is substantially the same as the display apparatus of the previous exemplary embodiment explained referring to FIGS. 1 to 6 except for the structure of the gamma reference voltage generator. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 5 and 7, the gamma reference voltage generator 240 of the present exemplary embodiment, the gamma reference voltage generator 240 according to the present exemplary embodiment may generate the gamma reference voltage (e.g. V87) at the predetermined grayscale point (e.g. 87 grayscale) using adjacent gamma voltages (e.g. V85 and V89) not by outputting the output of the amplifier (e.g. A87). An output terminal (e.g. OT87) of the amplifier (e.g. A87) may be disconnected from an output part (e.g. ON87) outputting the gamma reference voltage.

As shown in FIG. 7, a gamma reference voltage generating part corresponding to 87 grayscale may include a first resistor string RS87 disposed between a first reference voltage (e.g. VR1 of FIG. 2 or VR2 of FIG. 3) and a second reference voltage (V151 of FIG. 2 or 3), a first multiplexer MX87 connected to the first resistor string RS87 and determining a level of a first gamma reference voltage V87TEMP, and a first amplifier A87 connected to the first multiplexer MX87 and outputting the first gamma reference voltage V87TEMP.

A first resistor R86 may be disposed between the output terminal OT87 of the first amplifier A87 and a first previous gamma voltage output node ON86 of a present gamma voltage output node ON87. The first resistor R86 may be one of resistors disposed between the first amplifier A87 and a previous amplifier A51.

A second resistor R87 may be disposed between the output terminal OT87 of the first amplifier A87 and a first next gamma voltage output node ON88 of the present gamma voltage output node ON87. The second resistor R87 may be one of resistors disposed between the first amplifier A87 and a next amplifier A151.

A third compensating resistor RD3 may be disposed between a second previous gamma voltage output node (ON85 in the present exemplary embodiment) of the present gamma voltage output node ON87 and the present gamma voltage output node ON87.

A fourth compensating resistor RD4 may be disposed between a second next gamma voltage output node (ON89 in the present exemplary embodiment) of the present gamma voltage output node ON87 and the present gamma voltage output node ON87.

In the present exemplary embodiment, the first previous gamma voltage output node ON86 and the second previous gamma voltage output node ON85 may be different from each other and the first next gamma voltage output node ON88 and the second next gamma voltage output node ON89 may be different from each other.

The first previous gamma voltage output node ON86 may be a right previous output node ON86 of the present gamma voltage output node ON87. The first next gamma voltage output node ON88 may be a right next output node ON88 of the present gamma voltage output node ON87.

The second previous gamma voltage output node (e.g. ON85) may be one of previous output nodes of the first previous gamma voltage output node ON86. The second next gamma voltage output node (e.g. ON89) may be one of next output nodes of the first next gamma voltage output node ON88. In the present exemplary embodiment, the second previous gamma voltage output node ON85 may be a right previous output node of the first previous gamma voltage output node ON86 and the second next gamma voltage output node ON89 may be a right next output node of the first next gamma voltage output node ON88.

For example, the voltage of the output terminal OT87 of the first amplifier A87 may be referred as the first gamma reference voltage V87TEMP and the output voltage of the present gamma voltage output node ON87 may be referred as the first gamma compensated reference voltage V87. The first gamma compensated reference voltage V87 may be outputted to the data driver 260.

In the present exemplary embodiment, the average value of the gamma voltage of 86 grayscale and the gamma voltage of 88 grayscale is outputted as the gamma compensated reference voltage of 87 grayscale instead of the output voltage of the amplifier A87. However, the inventive concepts are not limited thereto. The gamma compensated reference voltages may be generated based on the adjacent gamma voltages at the predetermined grayscale points (e.g. 1 grayscale, 7 grayscale, 11 grayscale, 23 grayscale, 35 grayscale, 51 grayscale, 87 grayscale, 151 grayscale, and 203 grayscale).

According to the present exemplary embodiment, the gamma reference voltage V87 compensated using the voltage of the second previous output node ON85 of the present gamma voltage output node ON87 and the voltage of the second next output node ON89 of the present gamma voltage output node ON87 are outputted to the data driver 260 instead of the gamma reference voltage V87TEMP outputted from the first amplifier A87.

Thus, the vertex at 87 grayscale in FIG. 4 may be removed and the gamma smoothness at 87 grayscale may be changed to a value close to zero. Therefore, the distortion of the image may be prevented so that the display quality of the display panel 100 may be enhanced.

Figure 8:
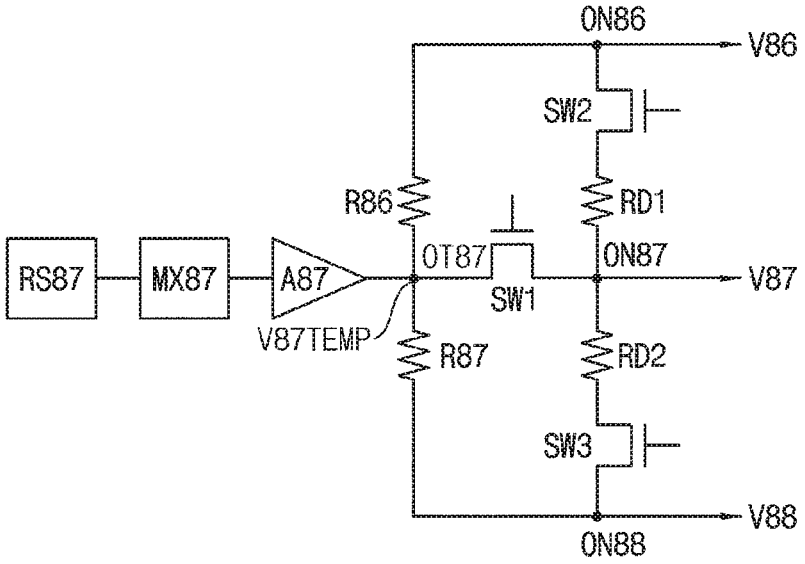
FIG. 8 is a circuit diagram illustrating a portion of a gamma reference voltage generator according to an exemplary embodiment of the inventive concepts generating a gamma reference voltage corresponding to 87 grayscale.

FIG. 8 is a circuit diagram illustrating a portion of a gamma reference voltage generator according to an exemplary embodiment of the inventive concepts generating a gamma reference voltage corresponding to 87 grayscale.

The display apparatus according to the present exemplary embodiment is substantially the same as the display apparatus of the previous exemplary embodiment explained referring to FIGS. 1 to 6 except for the structure of the gamma reference voltage generator. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 5 and 8, the gamma reference voltage generator 240 of the present exemplary embodiment, the gamma reference voltage generator 240 according to the present exemplary embodiment may generate the gamma reference voltage (e.g. V87) at the predetermined grayscale point (e.g. 87 grayscale) using adjacent gamma voltages (e.g. V86 and V88) and not by outputting the output of the amplifier (e.g. A87). An output terminal (e.g. OT87) of the amplifier (e.g. A87) may be disconnected from an output part (e.g. ON87) outputting the gamma reference voltage.

As shown in FIG. 8, a gamma reference voltage generating part corresponding to 87 grayscale may include a first resistor string RS87 disposed between a first reference voltage (e.g. VR1 of FIG. 2 or VR2 of FIG. 3) and a second reference voltage (V151 of FIG. 2 or 3), a first multiplexer MX87 connected to the first resistor string RS87 and determining a level of a first gamma reference voltage V87TEMP and a first amplifier A87 connected to the first multiplexer MX87 and outputting the first gamma reference voltage V87TEMP.

A first resistor R86 may be disposed between the output terminal OT87 of the first amplifier A87 and a first previous gamma voltage output node ON86 of a present gamma voltage output node ON87. The first resistor R86 may be one of resistors disposed between the first amplifier A87 and a previous amplifier A51.

A second resistor R87 may be disposed between the output terminal OT87 of the first amplifier A87 and a first next gamma voltage output node ON88 of the present gamma voltage output node ON87. The second resistor R87 may be one of resistors disposed between the first amplifier A87 and a next amplifier A151.

A first compensating resistor RD1 may be disposed between a second previous gamma voltage output node (ON86 in the present exemplary embodiment) of the present gamma voltage output node ON87 and the present gamma voltage output node ON87.

A second compensating resistor RD2 may be disposed between a second next gamma voltage output node (ON88 in the present exemplary embodiment) of the present gamma voltage output node ON87 and the present gamma voltage output node ON87.

In the present exemplary embodiment, the first previous gamma voltage output node ON86 and the second previous gamma voltage output node ON86 may be same and the first previous gamma voltage output node ON86 and the second previous gamma voltage output node ON86 may be a right previous output node ON86 of the present gamma voltage output node ON87.

In addition, the first next gamma voltage output node ON88 and the second next gamma voltage output node ON88 may be same and the first next gamma voltage output node ON88 and the second next gamma voltage output node ON88 may be a right next output node ON88 of the present gamma voltage output node ON87.

Alternatively, the second previous gamma voltage output node ON85 may be the second previous output node ON85 of the present gamma voltage output node ON87 and the second next gamma voltage output node ON89 may be the second next output node ON89 of the present gamma voltage output node ON87.

In the present exemplary embodiment, a gamma reference voltage compensating part RD1 and RD2 may operate according to an operation mode.

A first switch SW1 may be disposed between the output terminal OT87 of the first amplifier A87 and the present gamma voltage output node ON87. A second switch SW2 may be disposed between the second previous gamma voltage output node ON86 and the present gamma voltage output node ON87. The second switch SW2 may be connected to the first compensating resistor RD1 in series. A third switch SW3 may be disposed between the second next gamma voltage output node ON88 and the present gamma voltage output node ON87. The third switch SW3 may be connected to the second compensating resistor RD2 in series.

In the first operation mode, the first switch SW1 may be turned off and the second switch SW2 and the third switch SW3 may be turned on. When the first switch SW1 is turned off and the second switch SW2 and the third switch SW3 are turned on, the output terminal OT87 of the first amplifier A87 is disconnected from the present gamma voltage output node ON87 and the first gamma compensated reference voltage V87 is generated using the second previous gamma voltage V86 and the second next gamma voltage V88.

In the second operation mode, the first switch SW1 may be turned on and the second switch SW2 and the third switch SW3 may be turned off. When the first switch SW1 is turned on and the second switch SW2 and the third switch SW3 are turned off, the output terminal OT87 of the first amplifier A87 is connected to the present gamma voltage output node ON87 so that the output voltage V87TEMP of the first amplifier A87 is outputted as the first gamma compensated reference voltage V87 without compensation. In contrast, the second previous gamma voltage output node ON86 is disconnected from the present gamma voltage output node ON87 and the second next gamma voltage output node ON88 is disconnected from the present gamma voltage output node ON87.

For example, the voltage of the output terminal OT87 of the first amplifier A87 may be referred as the first gamma reference voltage V87TEMP and the output voltage of the present gamma voltage output node ON87 may be referred as the first gamma compensated reference voltage V87. The first gamma compensated reference voltage V87 may be outputted to the data driver 260.

In the present exemplary embodiment, the average value of the gamma voltage of 86 grayscale and the gamma voltage of 88 grayscale is outputted as the gamma compensated reference voltage of 87 grayscale instead of the output voltage of the amplifier A87. However, the inventive concepts are not limited thereto. The gamma compensated reference voltages may be generated based on the adjacent gamma voltages at the predetermined grayscale points (e.g. 1 grayscale, 7 grayscale, 11 grayscale, 23 grayscale, 35 grayscale, 51 grayscale, 87 grayscale, 151 grayscale and 203 grayscale).

According to the present exemplary embodiment, the gamma reference voltage V87 compensated using the voltage of the right previous output node ON86 of the present gamma voltage output node ON87 and the voltage of the right next output node ON88 of the present gamma voltage output node ON87 are outputted to the data driver 260 instead of the gamma reference voltage V87TEMP outputted from the first amplifier A87.

Thus, the vertex at 87 grayscale in FIG. 4 may be removed and the gamma smoothness at 87 grayscale may be changed to a value close to zero. Therefore, the distortion of the image may be prevented so that the display quality of the display panel 100 may be enhanced.

In addition, the compensation of the gamma reference voltage V87 may be selectively operated using the first to third switches SW1, SW2 and SW3.

Figure 9:
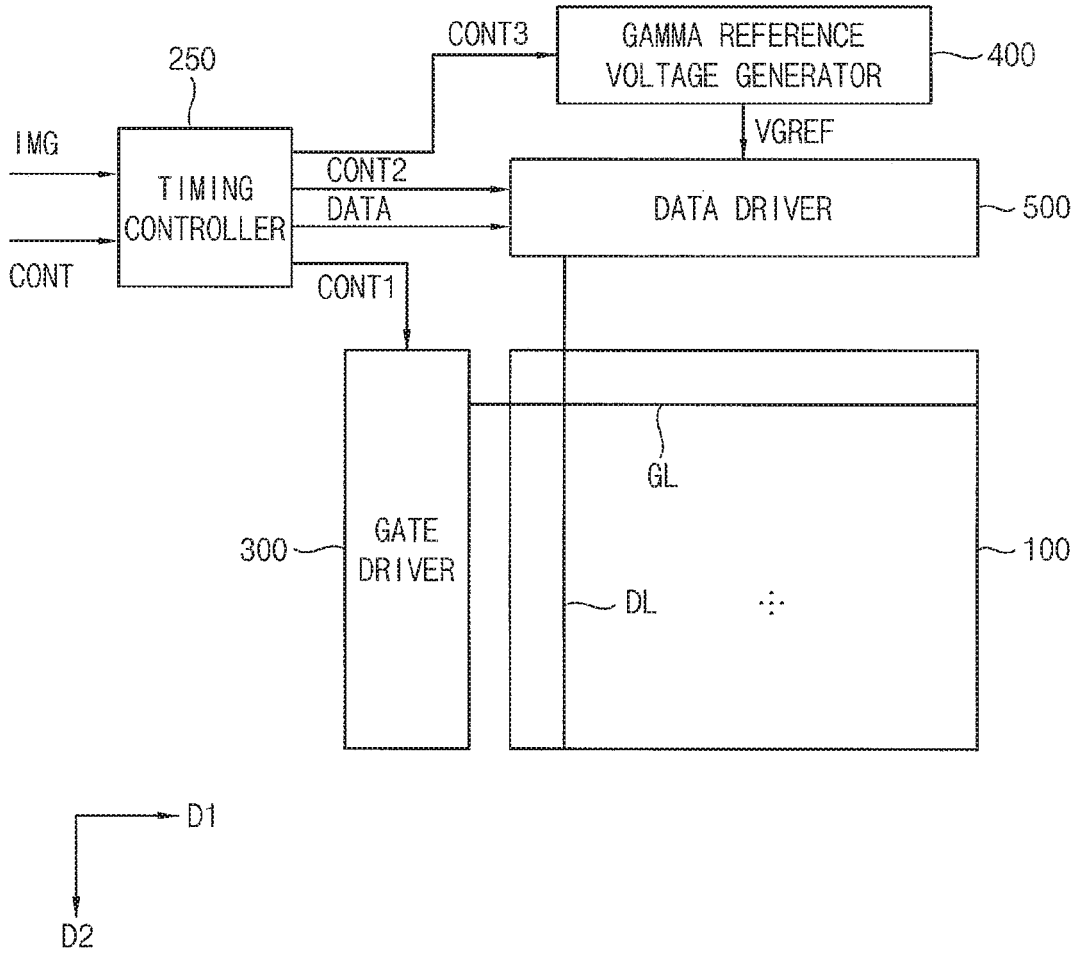
FIG. 9 is a block diagram illustrating a display apparatus according to an exemplary embodiment of the inventive concepts.

FIG. 9 is a block diagram illustrating a display apparatus according to an exemplary embodiment of the inventive concepts.

The display apparatus according to the present exemplary embodiment is substantially the same as the display apparatus of the previous exemplary embodiment explained referring to FIGS. 1 to 6 except for the structures of the timing controller, the gamma reference voltage generator, and the data driver. Thus, the same reference numerals will be used to refer to the same or like parts as those described in the previous exemplary embodiment of FIGS. 1 to 6 and any repetitive explanation concerning the above elements will be omitted.

Referring to FIGS. 2 to 9, the display apparatus includes a display panel 100, a timing controller 250, a gate driver 300, a gamma reference voltage generator 400, and a data driver 500.

In the present exemplary embodiment, the timing controller 250, the gamma reference voltage generator 400 and the data driver 500 may be independently formed. For example, the timing controller 250 may be formed as a first chip. The data driver 500 may be formed as a second chip. The gamma reference voltage generator 400 may be formed as a third chip. Alternatively, the gamma reference voltage generator 400 may be integrated with the timing controller 250 or the data driver 500.

The gamma reference voltage generating part 400 may generate a plurality of gamma reference voltages corresponding to predetermined grayscale values based on reference voltages. The gamma reference voltage generating part 400 may generate a plurality of gamma voltages corresponding to remaining grayscale values, except for the predetermined grayscale values, by interpolating the gamma reference voltages.

The gamma reference voltage generator 400 according to the present exemplary embodiment may generate the gamma reference voltage (e.g. V87) at the predetermined grayscale point (e.g. 87 grayscale) using adjacent gamma voltages (e.g. V86 and V88) not by outputting the output of the amplifier (e.g. A87). An output terminal (e.g. OT87) of the amplifier (e.g. A87) may be disconnected from an output part (e.g. ON87) outputting the gamma reference voltage.

According to the present exemplary embodiment, the gamma reference voltage V87 compensated using the voltage of the right previous output node ON86 of the present gamma voltage output node ON87 and the voltage of the right next output node ON88 of the present gamma voltage output node ON87 are outputted to the data driver 500 instead of the gamma reference voltage V87TEMP outputted from the first amplifier A87.

Thus, the vertex at 87 grayscale in FIG. 4 may be removed and the gamma smoothness at 87 grayscale may be changed to a value close to zero. Therefore, distortion of the image may be prevented so that the display quality of the display panel 100 may be enhanced.

According to the gamma reference voltage generating circuit of the inventive concepts as explained above, the display apparatus including the gamma reference voltage generating circuit and the method of driving the display panel using the display apparatus, the gamma reference voltage generating circuit generates the gamma reference voltage based on the adjacent gamma voltages so that the gamma smoothness may not be reduced in the specific grayscale values. Thus, the display quality of the display panel may be enhanced.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A gamma reference voltage generating circuit comprising:

a first resistor string disposed between a first reference voltage node and a second reference voltage node;

a first multiplexer connected to the first resistor string and configured to determine a level of a first gamma reference voltage;

a first amplifier connected to the first multiplexer and configured to output the first gamma reference voltage;

a first resistor connected between an output terminal of the first amplifier and a first previous gamma voltage output node of a present gamma voltage output node;

a second resistor connected between the output terminal of the first amplifier and a first next gamma voltage output node of the present gamma voltage output node;

a first compensating resistor connected between a second previous gamma voltage output node of the present gamma voltage output node and the present gamma voltage output node;

a second compensating resistor connected between a second next gamma voltage output node of the present gamma voltage output node and the present gamma voltage output node, a first switch disposed between the output terminal of the first amplifier and the present gamma voltage output node;

a second switch disposed between the second previous gamma voltage output node and the present gamma voltage output node and connected to the first compensating resistor in series; and a third switch disposed between the second next gamma voltage output node and the present gamma voltage output node and connected to the second compensating resistor in series.

2. The gamma reference voltage generating circuit of claim 1, wherein:

the first previous gamma voltage output node is the same as the second previous gamma voltage output node;

the first previous gamma voltage output node and the second previous gamma voltage output node are a right previous output node of the present gamma voltage output node;

the first next gamma voltage output node is the same as the second next gamma voltage output node; and the first next gamma voltage output node and the second next gamma voltage output node are a right next output node of the present gamma voltage output node.

3. The gamma reference voltage generating circuit of claim 1, wherein:

the first previous gamma voltage output node is different from the second previous gamma voltage output node; and the first next gamma voltage output node is different from the second next gamma voltage output node.

4. The gamma reference voltage generating circuit of claim 3, wherein:

the first previous gamma voltage output node is a right previous output node of the present gamma voltage output node; and the first next gamma voltage output node is a right next output node of the present gamma voltage output node.

5. The gamma reference voltage generating circuit of claim 4, wherein:

the second previous gamma voltage output node is one of previous output nodes of the first previous gamma voltage output node; and the second next gamma voltage output node is one of next output nodes of the first next gamma voltage output node.

6. The gamma reference voltage generating circuit of claim 1, wherein:

the first switch is turned off and the second switch and the third switch are turned on in a first operation mode; and the first switch is turned on and the second switch and the third switch are turned off in a second operation mode.

7. A gamma reference voltage generating circuit comprising:

a first resistor string disposed between a first reference voltage node and a second reference voltage node;

a first multiplexer connected to the first resistor string and configured to determine a level of a first gamma reference voltage;

a first amplifier connected to the first multiplexer and configured to output the first gamma reference voltage;

a first resistor connected between an output terminal of the first amplifier and a first previous gamma voltage output node of a present gamma voltage output node;

a second resistor connected between the output terminal of the first amplifier and a first next gamma voltage output node of the present gamma voltage output node;

a first compensating resistor connected between a second previous gamma voltage output node of the present gamma voltage output node and the present gamma voltage output node;

a second compensating resistor connected between a second next gamma voltage output node of the present gamma voltage output node and the present gamma voltage output node;

a second resistor string disposed between a third reference voltage node and a fourth reference voltage node;

a second multiplexer connected to the second resistor string and configured to determine a level of a second gamma reference voltage corresponding to a grayscale value lower than the first gamma reference voltage;

a second amplifier connected to the second multiplexer and configured to output the second gamma reference voltage; and a first group of resistors disposed between the output terminal of the first amplifier and an output terminal of the second amplifier, wherein the fourth reference voltage is a voltage of the output terminal of the first amplifier.

8. The gamma reference voltage generating circuit of claim 7, further comprising:

a third resistor string disposed between a fifth reference voltage node and a sixth reference voltage node;

a third multiplexer connected to the third resistor string and configured to determine a level of a third gamma reference voltage corresponding to a grayscale value greater than the first gamma reference voltage;

a third amplifier connected to the third multiplexer and configured to output the third gamma reference voltage; and a second group of resistors disposed between the output terminal of the first amplifier and an output terminal of the third amplifier, wherein the second reference voltage is a voltage of the output terminal of the third amplifier.

9. A method of driving a display panel, the method comprising:

generating a first gamma reference voltage corresponding to a first grayscale value, a second gamma reference voltage corresponding to a second grayscale value greater than the first grayscale value, and a third gamma reference voltage corresponding to a third grayscale value greater than the second grayscale value;

generating a previous gamma voltage of the second gamma reference voltage using the first gamma reference voltage and the second gamma reference voltage, and a next gamma voltage of the second gamma reference voltage using the second gamma reference voltage and the third gamma reference voltage;

generating a second gamma compensated reference voltage corresponding to the second grayscale value based on the previous gamma voltage of the second gamma reference voltage and the next gamma voltage of the second gamma reference voltage;

outputting a gate signal to the display panel; and outputting a data voltage based on a plurality of gamma reference voltages including the first gamma reference voltage, the second gamma compensated reference voltage, and the third gamma reference voltage.

10. The method of claim 9, wherein the second gamma compensated reference voltage is generated using:

a first resistor disposed between a present gamma voltage output node configured to output the second gamma compensated reference voltage and a previous gamma voltage output node configured to output the previous gamma voltage of the second gamma reference voltage; and a second resistor disposed between the present gamma voltage output node and a next gamma voltage output node configured to output the next gamma voltage of the second gamma reference voltage.

11. The method of claim 10, wherein:

the previous gamma voltage output node is a right previous output node of the present gamma voltage output node; and the next gamma voltage output node is a right next output node of the present gamma voltage output node.

12. The method of claim 10, wherein:

the previous gamma voltage output node is a second previous output node from the present gamma voltage output node; and the next gamma voltage output node is a second next output node from the present gamma voltage output node.

13. The method of claim 10, wherein a first switch is disposed between a node generating the second gamma reference voltage and a node outputting the second gamma compensated reference voltage.

14. The method of claim 13, wherein:

a second switch is disposed between the previous gamma voltage output node and the present gamma voltage output node; and a third switch is disposed between the next gamma voltage output node and the present gamma voltage output node.

15. The method of claim 14, wherein:

the first switch is turned off and the second switch and the third switch are turned on in a first operation mode; and the first switch is turned on and the second switch and the third switch are turned off in a second operation mode.

* * * * *